US005388292A

United States Patent [19]

Stinson et al.

[11] Patent Number: 5,388,292

[45] Date of Patent: Feb. 14, 1995

[54] FLUID FILLED MATTRESS WITH FOAM FILLED CHAMBERS

[75] Inventors: D. Ray Stinson, 3000 N. Atlantic Ave. #4, Daytona Beach, Fla. 32118; Peter A. Keay, Ormond Beach, Fla.

[73] Assignees: D. Ray Stinson; Linda Stinson, Ormond Beach, Fla.

[21] Appl. No.: 12,283

[22] Filed: Feb. 1, 1993

Related U.S. Application Data

[63] Continuation-in-part of Ser. No. 658,199, Feb. 20, 1991, Pat. No. 5,182,825.

[51] Int. Cl.[6] ..... A47C 27/10; A61G 7/057

[52] U.S. Cl. ..... 5/450; 5/451; 5/453; 5/455; 5/457

[58] Field of Search ..... 5/455, 450, 449, 451, 5/452, 453, 457, 458

[56] References Cited

U.S. PATENT DOCUMENTS

| | | | |
|---|---|---|---|
| 2,691,179 | 10/1954 | Kann | 5/450 |
| 2,748,399 | 6/1956 | Rockoff | 5/450 |
| 4,221,013 | 9/1980 | Ecmevarria | 5/451 |
| 4,306,322 | 12/1981 | Young et al. | 5/449 |
| 4,394,784 | 7/1983 | Swenson et al. | 5/455 |
| 4,777,679 | 10/1988 | De Looper | 5/455 |
| 4,803,744 | 2/1989 | Peck et al. | 5/455 |
| 4,912,789 | 4/1990 | Maxwell | 5/450 |
| 4,947,500 | 8/1990 | Seiler | 5/453 |
| 4,951,335 | 8/1990 | Eady | 5/455 |

FOREIGN PATENT DOCUMENTS

| | | | |
|---|---|---|---|
| 1422306 | 11/1965 | France | 5/455 |

*Primary Examiner*—Alexander Grosz
*Attorney, Agent, or Firm*—Allen, Dyer, Doppelt, Franjola & Milbrath

[57] ABSTRACT

A healthcare mattress useful in avoiding pressure ulcers while providing long-term patient comfort, is comprised of a foam support with a bottom and sides that define a cavity adapted to accomodate a plurality of bladders with first and second bladders placed upon the support with the first bladder positioned above the second bladder, each bladder formed of plural, generally parallel plastic sheets forming a plurality of elongated chambers extending in a generally parallel direction across each bladder with adjacent chambers in fluid communication, with an elongated foam member disposed in each of the elongated chambers of at least the second bladder and means for maintaining a fluid pressure within each of the elongated chambers of the first and second bladders, wherein the first and second bladders are disposed with the parallel direction of the elongated chambers of the first bladder substantially normal to the parallel direction of the elongated chambers of the second bladder.

19 Claims, 5 Drawing Sheets

FIG. G
(PRIOR ART)

FIG. 10
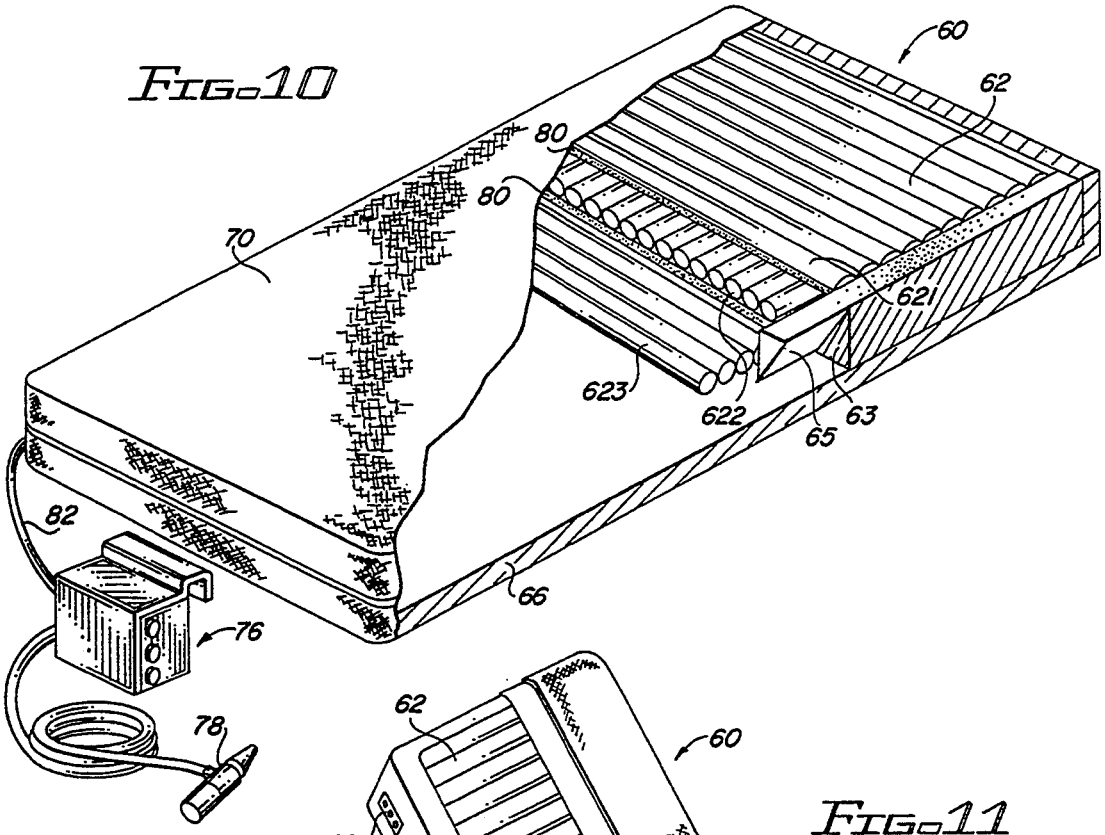
FIG. 11
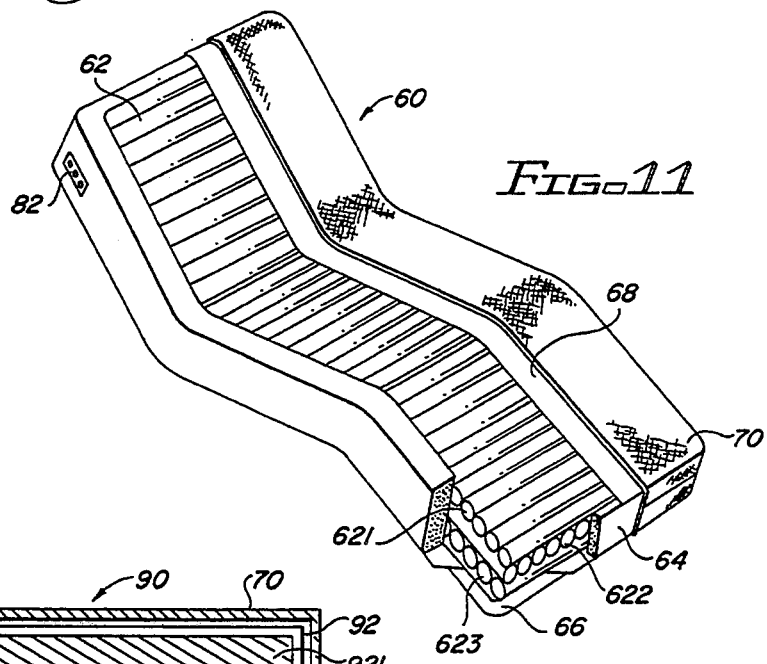
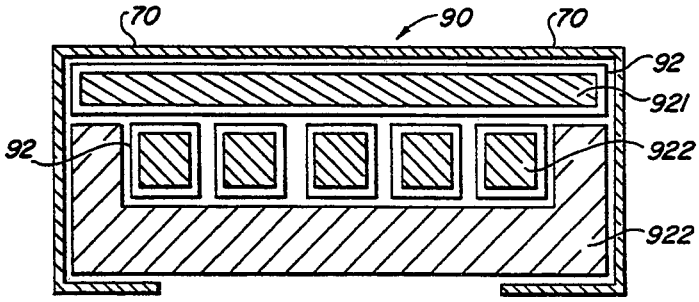
FIG. 12

FLUID FILLED MATTRESS WITH FOAM FILLED CHAMBERS

BACKGROUND OF THE INVENTION

This application is a continuation-in-part of patent application Ser. No. 07/658,199, filed on Feb. 20, 1991, now U.S. Pat. No. 5,182,825 issuing on Feb. 2, 1993.

BACKGROUND OF THE INVENTION

This invention relates to improved inflatable mattresses, methods and components for constructing and using the same. More specifically, the invention relates to improved mattress constructions used to assist a care giver in the prevention and treatment of pressure ulcers. Replacement mattresses have been designed to reduce pressures on the patient to below the typical hospital mattress and are intended to replace conventional hospital mattresses.

A typical bed used in nursing homes, hospitals, and other health care facilities employs a conventional mattress and box spring combination. Inflatable mattresses, such as waterbeds, are an inexpensive alternative to the conventional type of health-care bed. Waterbeds typically have a flat support and a rectangular frame enclosing the sides of a water-filled bladder that rests on the support. The bladder is covered with a protective sheet, and the patient rests on the covered bladder.

A drawback to waterbeds is that certain portions of a patient's body are heavier than other portions, and when the patient rests on the waterbed, the heavier portions push down into the waterbed's bladder. Thus, the water-filled bladder must be thick enough to prevent the patient from pushing down far enough to contact the hard supporting surface below. To prevent this contact, the waterbed bladder must be thick when filled with water. Consequently, the waterbed becomes heavy, making it difficult to move the bed without draining the bladder. If the patient must be moved, the patient must be lifted off the bed and put on a movable bed, or transport cart.

Another drawback to the use of waterbeds in health-care facilities is that dust or other particles may fall into the crevices between the bladder and the frame. Consequently, it is difficult to keep waterbeds clean and sterile.

Air-filled mattresses also suffer difficulties which have limited their use in health-care facilities.

It is well accepted to those skilled in the art that many factors play a role in the etiology and pathogenesis of pressure ulcers. Factors such as overall physical condition, mental status, activity, mobility, nutritional status and incontinence can all be used to assess the risk of a patient for the development of pressure ulcers. However, the primary cause is generally accepted to be an external pressure exceeding the internal capillary blood pressure of 32 mm Hg. As a result, pressure relief is a primary goal in the prevention and treatment of pressure ulcers. This goal prompted the Gaymar Industries, Inc. of Orchard Park, N.Y. to conduct a study published in April 1992 evaluating capillary pressure on the patient for various replacement mattresses and compare the results to pressures from a standard hospital mattress. The study revealed that of the seven hospital replacement mattresses studied, none were able to relieve trochanteric or heel pressure below that of capillary closure. Those tested did relieve pressure at the sacrum below the 32 mm level.

SUMMARY OF THE INVENTION

An object of this invention is to provide improved mattress constructions and methods which are particularly suited for use in health-care facilities.

Another object of the invention is to provide an inflatable mattress construction having individually separable bladders that are easily removable.

A further object of the invention is to provide an improved cover for enclosing a waterbed bladder.

Another object of this invention is to improve the method of transporting a waterbed in a health-care facility.

It is also an object of this invention to cover a waterbed using an improved zipper to seal a waterbed bladder within the cover.

An additional object of the invention is to improve a footrest for use on a waterbed.

It is another object of this invention to provide a waterbed that fits on a sliding transfer board that can be easily transported without the pieces on the board falling off.

It is also an object of the invention to provide a construction of an improved air mattress.

To achieve these objects an inflatable mattress is provided comprising a plurality of removable bladders resting on a supporting surface and adapted for holding a fluid, each bladder having means for physically attaching itself to an adjacent bladder so that the bladders remain attached when moved with a transport board.

In a preferred form, a mattress adapted to be supported on a transportable board includes a bladder adapted to be filled with a fluid and constructed from a flexible material, the bladder being enclosed with a liner having a pocket that is adapted to mate with the transfer board such that when the bladder is transported on the transfer board, the liner remains attached to the board to constrain the bladder.

In an alternate form, the waterbed comprises a bladder adapted for holding a fluid and supporting a person in a horizontal position, means for completely covering the bladder having an opening bordering by the edges of the covering means wherein the bladder may be inserted and removed from the cover means through the openings, and means for drawing the edges of the covering means together to close the opening, thereby providing an airtight seal around the bladder. By sealing the bladder air-tight, the person supported on the mattress is protected.

In another alternate form the mattress includes a first bladder adapted for holding water and for supporting a person, and means for supporting said bladder when the person is supported on the bladder. The mattress also includes a cover means for enclosing the bladder and a second cover means enclosing the first cover for reducing shearing of the skin of the person when the person is supported on the mattress.

In an alternate form, the mattress for use in a health-care facility is provided comprising a first bladder adapted for holding water and for supporting a person, a foam inlay disposed about the periphery of the bladder and a cover enclosing the foam inlay and the bladder air-tight. The mattress further comprises a transfer board disposed below and supporting the cover, bladder and foam inlay, and a plurality of handles on the transfer board for transporting the mattress.

Further, to achieve these above objects, the invention includes a method of elevating the foot of a person lying in a horizontal position on the bed comprises the steps of filling a substantially cylindrical-shaped container constructed from a flexible plastic material with a fluid, and placing the fluid-filled cylindrical-shaped container on the foot of the bed, such that when a person lies on the bed, the feet of the person rests on the container and are elevated.

In the preferred form, the method of constructing a mattress is provided comprising the steps of providing a transport board having a plurality of handles disposed thereon, providing a fluid-filled bladder, and resting the bladder on the transfer board such that the bladder may be transported by moving the transfer board using the handles. The method further comprises the step of enclosing the bladder with a liner, and covering a portion of the transport board with a pocket disposed on the liner, such that the mattress is constrained on the transport board while the transport board is being moved.

The bladder comprises a continuous baffle affixed via an improved welding method to bladder top and bottom surfaces. In an alternate embodiment, multiple continuous baffles are employed.

In another embodiment, air is used as a floatation medium in an improved air mattress employing low pressures. Another embodiment of the air mattress comprises a filler material used in combination with the air.

DESCRIPTION OF THE DRAWINGS

A preferred embodiment of the invention as well as alternate embodiments are described by way of example with reference to the accompanying drawings in which:

FIG. 3F and 3G, show cross-sections of various prior art weld configurations illustrating the angle of tearing force for these configurations;

FIG. 10 is a perspective cut-away view of the air mattress embodiment of FIG. 9 illustrating the use of a regulator and air supply;

FIG. 11 is another perspective cut-away view in a mattress embodiment with integral regulators;

FIG. 12 is a partial cross-sectional view of an embodiment of the invention comprising an air and foam configuration;

DESCRIPTION OF THE PREFERRED EMBODIMENTS

Figure 1:
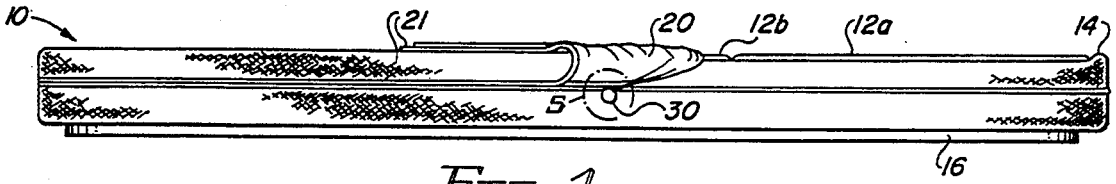
FIG. 1 is a side view of the mattress in a preferred embodiment.
Figure 2:
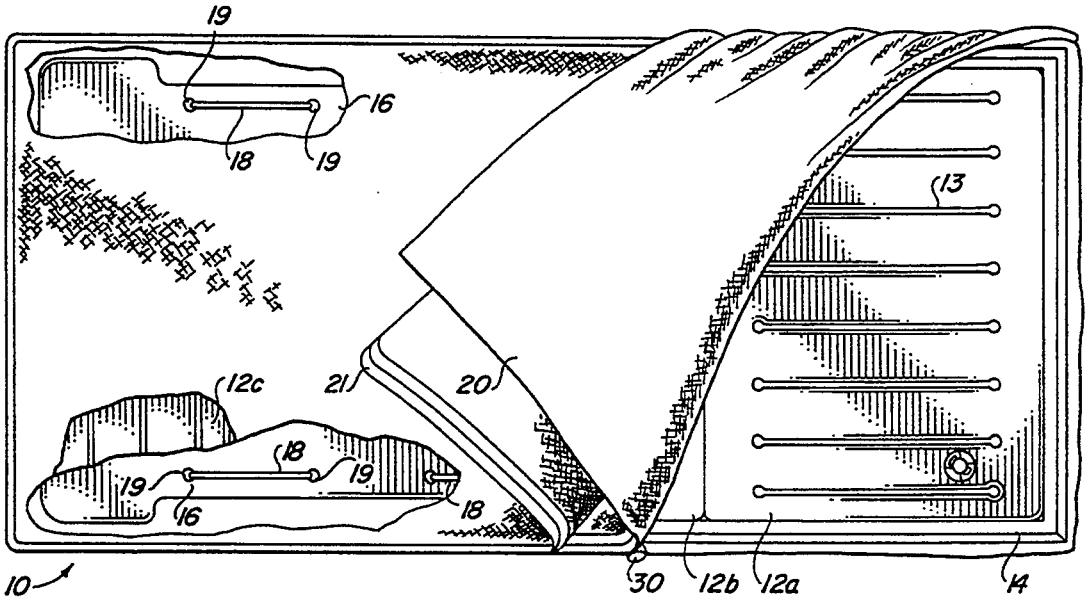
FIG. 2 is a top view of the mattress having a multiplicity of bladders and a foam inlay, resting on a transfer board.

Referring to FIGS. 1–4, there is shown a mattress 10 having a plurality of water-filled vinyl bladders 12*a–c* held in place with surrounding foam inlay 14. Bladders 12*a–c* each preferably have dimensions of 23–27 inches long by 34 inches wide by 4 inches deep when full and contain baffles 13 forming partitions to reduce wave action. Referring to FIGS. 1 and 2, bladders 12*a–c* and foam inlay 14 rest on transfer board 16 having handles 18 for holding mattress 10 during transport. Bladders 12*a–c* and foam inlay 14 are enclosed with a plastic safety sealed cover 20 and durable cover 21.

Figure 3:
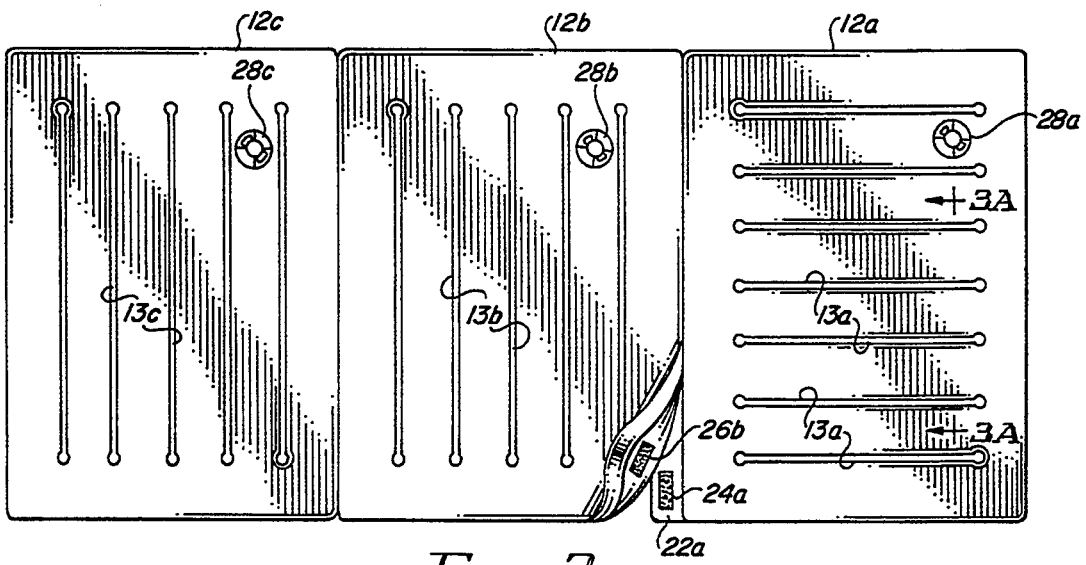
FIG. 3 is a top view of three bladders resting on the transfer board.
Figure 4:
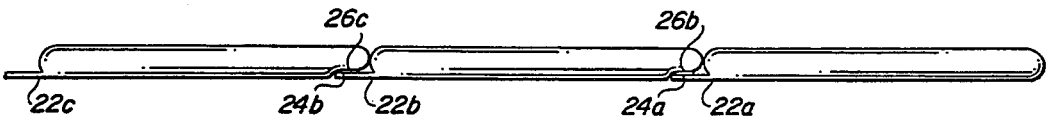
FIG. 4 is a side view of the mattress configuration shown in FIG. 3.

Referring to FIGS. 3 and 4, bladders 12*a–c* each contain a flap 22*a–c*respectively. Flaps 22(*a–b*) have hook-and-loop fastener strips 24*a* and 24*b* (FIG. 4) that removably attach to mating hook-and-loop fastener strips 26*b* and 26*c* (FIG. 4) located on the bottom of bladders 12(*b–c*). Referring to FIG. 3, bladders 12(*a–c*) have a removable plug 28*a–c* through which water enters and is drained. It is recognized that bladders 12*a–c* may be removably attached to each other to allow ease in transport and storage without draining as each bladder, when full, weighs 120–150 pounds.

Figure 3A:
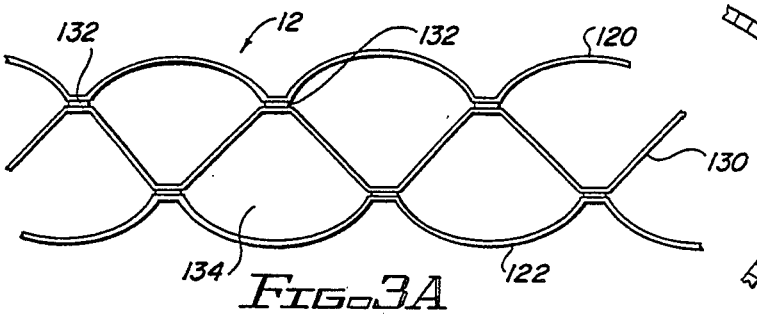
FIG. 3A is a partial cross-sectional side view of the bladder in the preferred embodiment comprising improved baffles and welds configured in a triangle shaped baffle pattern.
Figure 3B:
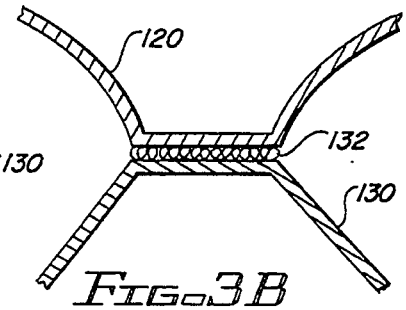
FIG. 3B is an enlarged view of a portion FIG. 3A.

Referring to FIGS. 1 and 3, each bladder 12*a–c* contains a multiplicity of baffles 13*a–c*. The baffles 13*a–c* join the bladder top surface 120 with the bottom surface 121. Baffles 13*a–c* provide a barrier within bladder 12*a–c* such that when the bladders containing water are depressed, wave action is suppressed and distention is limited. In the preferred embodiment of the bladder 12, the baffles 13 comprise a continuous baffle 130 as illustrated in FIG. 3A. The bladder top surface 120 is affixed to the continuous baffle 131 at a plurality of weld lines 132. The bladder bottom surface 122 is affixed to the continuous baffle 130 in an alternating pattern by similar weld lines 132 further illustrated in FIG. 3A. The alternating pattern forms compartments 134 containing the water.

Figure 3C:
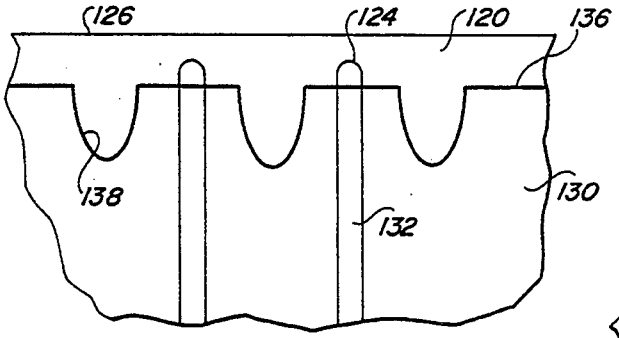
FIG. 3C is a partial top view of the continuous baffle welded to the bladder illustrating the method of taking the weld past the baffle and onto the bladder close to the bladder edge.

FIG. 3C is a partial cut-away view of the continuous baffle 130 illustrating by way of example the weld 132 of the baffle 130 to the bladder top surface 120. The weld 132 of the baffle 130 to the bladder surface 120 extends beyond the baffle edge 136 and proximate to the bladder edge 126 as illustrated in FIG. 3C. Baffle openings 138 allow communication between the compartments 134 for water flow, and are gradually shaped as shown in FIG. 3C to spread stresses back toward the center of the baffle.

Figure 3D:
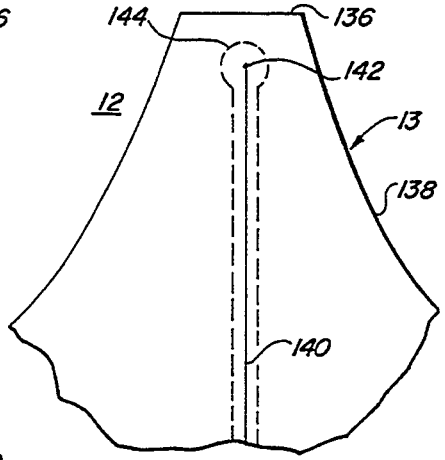
FIG. 3D (PRIOR ART)
FIG. 3D is a partial top view of a weld known in the art.
Figure 3E:
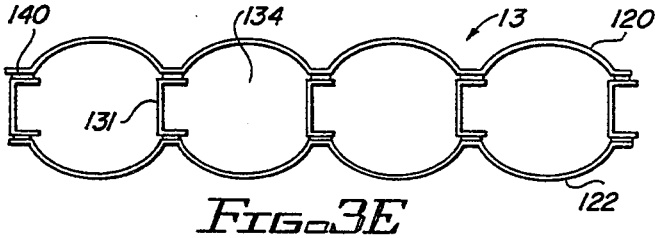
FIG. 3E (PRIOR ART)
FIG. 3E is a partial cross-sectional side view illustrating an individual baffles and weld configuration known in the prior art.

As illustrated in FIG. 3D, a typical weld 140 of a baffle 13 to a bladder 12 comprises extending the weld beyond the contact point 142 to a tear shape 144 within the baffle edge 136. A bladder cross-section for such a configuration is illustrated in FIG. 3E showing the bladder top surface 120 and bladder bottom surface 122 affixed to a plurality of individual baffles 131 with a typical weld 140. The use of the continuous baffle 130 dramatically reduces the tearing forces 146 at the weld 132 compared to the tearing forces 132 at the weld 140, as presently known and used in the art.

Figure 3F:
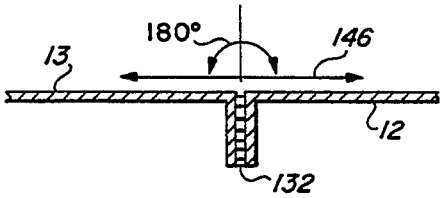
FIG. 3F (PRIOR ART)
Figure 3H:
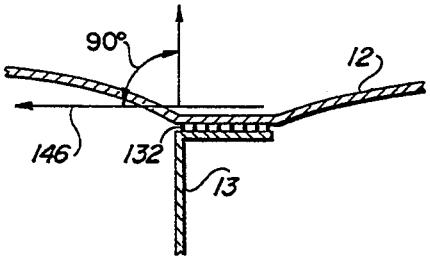
FIG. 3H is a cross-sectional side view of the weld of FIGS. 3A and 3B, illustrating the angle of tearing force.
Figure 3H:
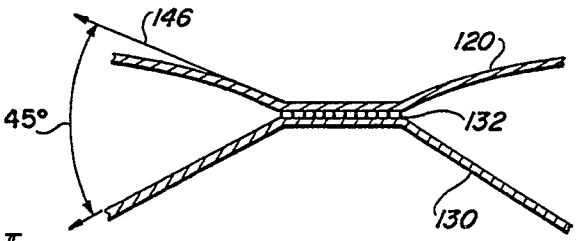

As further explanation of tearing force 146 and by way of example in illustrating the improvements realized in the invention over the known art, consider FIGS. 3F, 3G, and 3H. By reference to FIG. 3F, it can be seen that a worst case tearing force 146 would be realized for a bladder 12 and a baffle 13 affixed with a weld 132 where the tearing forces 146 were pulling or stressing the components at a 180 angle between bladder 12 and baffle 13. Angles of about 90 at the weld 132 between the bladder 12 and the baffle 13 are as illustrated in FIG. 3G. The invention reduces this angle between the bladder 12 and the baffle 13 by approximately 50%, as illustrated in FIG. 3H. The angle between the bladder top surface 120 and the continuous baffle 130 is approximately 45 at the weld 132 resulting in a dramatic reduction in tearing force 146.

Again with reference to FIG. 3A, the alternating welds 130 between the bladder top surface 120 and the bottom surface 122 forms triangular shaped baffle compartments 134. This configuration provides inherent stability. Compare the triangular shape formed by the continuous baffle 130 shown in FIG. 3A with the individual baffle 131 shown in FIG. 3E. The individual baffle 131 will have a tendency to sway left to right as weight is placed on the mattress 10 and water or other fluid is forced to shift within the bladder compartments 134. This configuration also provides reduced forces that cause tearing and inherent distribution of applied weight such as is present when a patient is lying on the mattress 10. Tearing forces 146 that tend to peel or tear the weld are applied at much reduced angles as seen in FIG. 3H and are evenly distributed across the edges of the weld at a favorable angle. By using the continuous baffle 130, the number of components associated with the bladder 12 are reduced as is the manufacturing process. The oblique posture of the baffle lends itself to increase stability over the typical baffle arrangement.

Figure 3I:
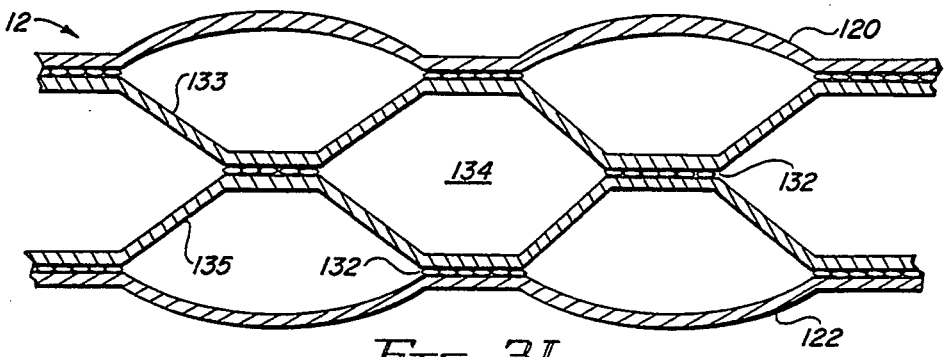
FIG. 3I a is cross-sectional side view of another baffle embodiment comprising a plurality of continuous baffles forming a honeycomb.

In yet another embodiment using continuous baffles 130, FIG. 3I illustrates the use of an upper baffle 133 and a lower baffle 135 affixed to each other with welds 132 and to the bladder top surface 120 and bladder bottom surface 122 in a fashion similar to the single continuous baffle system. The two baffles 133 and 135 form a "honeycomb" design when viewing the bladder 12 in cross-section as illustrated in FIG. 3I.

Referring to FIG. 3, the baffles **13*a* in bladder 12*a* are disposed in a longitudinal orientation on mattress 10 and baffles 13*b* and 13*c* are disposed in a lateral orientation. Bladders 12*a–c*** are preferably formed using a lapp seam sealing technique whereby one edge of the bladder is welded over another edge in an overlapping manner. This lapp seam provides better durability and less resistance to leakage than conventional seam sealing techniques.

Referring to FIG. 1 and FIG. 2, foam inlay 14 provides support for bladders 12, however, any material that provides support for bladders **12*a–c* can be used. Foam inlay 14** preferably has an outer dimension of 80 inches long by 35 inches wide and 3–5 inches high.

Transfer board 26 is preferably made from a rigid material such as wood and has handles 28 constructed from nylon. Handles 18 insert into holes 19 drilled into transfer board 16 in two parallel rows adjacent the edge of transfer board 16. Handles 18 are inserted in holes 19. Handles 18 are preferably six inches long and are spaced 10 inches apart. Although handles 18 shown are inserted into transfer board 16, transfer board 16 may be easily modified to eliminate nylon handles and have alternate handles cut out of transfer board 16.

Figure 5:
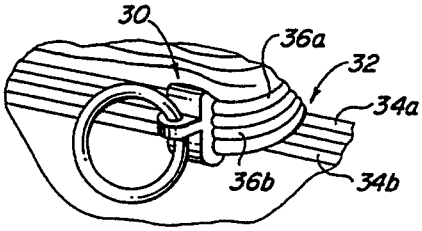
FIG. 5 is a side view of the zipper on the mattress.

Sealed cover 20 is preferably constructed from a flexible plastic material, such as vinyl and has a zipper 30. Referring to FIGS. 1, 2 and 5, zipper 30 may be opened to allow bladders **12*a–c* and foam inlay 14 to be inserted and removed from within sealed cover 20. Sealed cover 20 has an opening 32 and two parallel sets of ridges 34*a–b* and 36*a–b*. Ridges 34*a–b* engage with ridges 36*a–b* when zipper 30 slides to provide a double seal along opening 32. When zipper 30 is slid shut, foam inlay 14 and bladders 12*a–c* are sealed air-tight within sealed cover 20**.

Enclosing sealed cover 21 is durable cover 21, preferably constructed from Dura Blue material available from American Health Systems of Greenview, S.C. Durable cover 21 insulates the patient on mattress 10 from sealed cover 20. Durable cover 21 provides an outer enclosure to permit ease in cleanup by being easy to remove from sealed cover 21. Durable cover 21 also reduces shearing of the skin of a patient resting on mattress 10.

Figure 6:
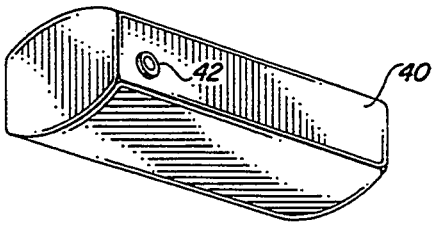
FIG. 6 is a plan view of the footrest.

Referring to FIG. 6, there is shown a water-filled footrest 40 which is constructed from a plastic material and is cylindrical shaped. Footrest 40 has a removable plug 42 to allow water to be filled and drained. It is preferable that footrest 40 only be partially filled with water to provide a softer cushion. Footrest 40 during use may be placed under the foot of a person resting on mattress 10 or of any bed.

Figure 7:
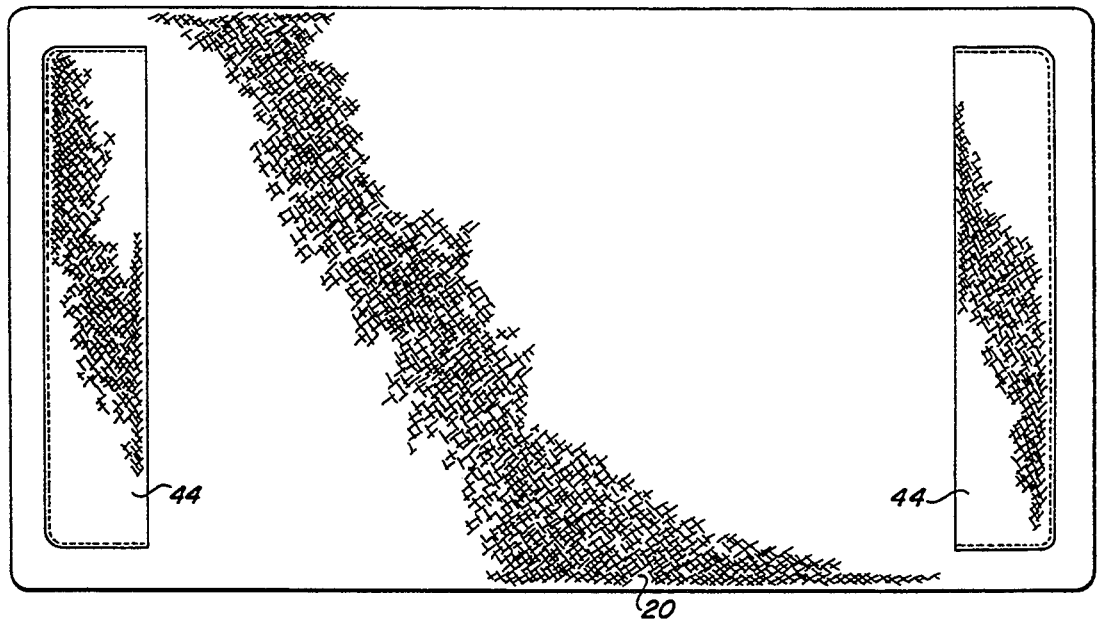
FIG. 7 is a bottom view of the mattress cover having pockets that mate with the transfer board.

Referring to FIG. 7, there are shown pockets 44 fastened to the bottom surface of sealed cover 20. Pockets 44 are located adjacent the ends of sealed cover 20 and are adapted to mate with the end portion of transfer board 16. Pockets 44 constrain cover sealed 20 to transfer board 16 to allow ease in transporting mattress 01. Pockets 44 preferably have a width of 11 inches and a length of 32 inches.

Figure 8:
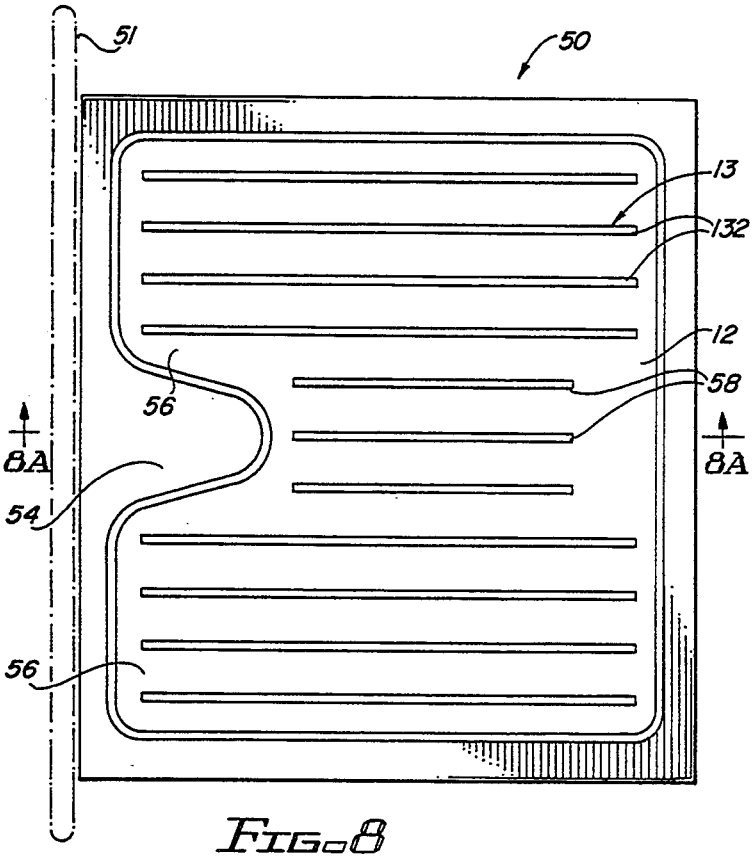
FIG. 8 is a top view of a mattress configured for use on a chair.
Figure 8A:
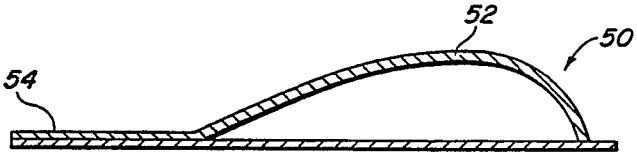
FIG. 8A is a partial cross-sectional view of the chair mattress embodiment of FIG. 8.

A second embodiment of the invention is shown as a chair mattress 50 in FIG. 8 where the bladder 12 is formed to be received by a chair seat as in a wheelchair (not shown). In the preferred embodiment, two sets of full length welds 56 are placed on the sides of shortened center welds 58 as shown in FIG. 8. The length of the baffle welds 132 for the baffles 13 at various locations within the mattress 50 force a contour 52 as shown in the cross-sectional view in FIG. 8A. This contour 52 forces the occupant of the chair to be held back into the rear 51 of the chair, depicted by a dotted line on the left side of FIG. 8. This keeps the occupant from sliding down and out of the chair which is typical especially for elderly and weakened patients. A coccyx cut 54 is made in the mattress to provide relief at the coccyx region of the body.

Figure 9:
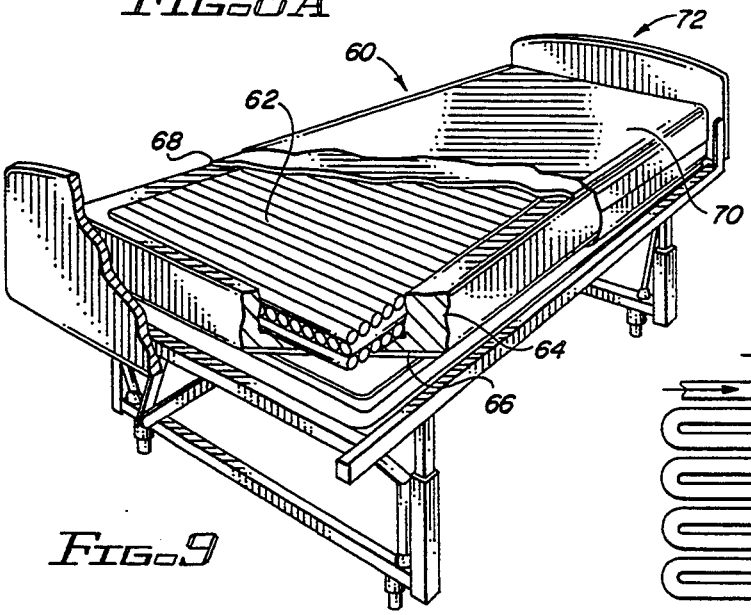
FIG. 9 is a perspective drawing partially cut away, of a bed employing an air mattress in accordance with this invention.
Figure 9A:
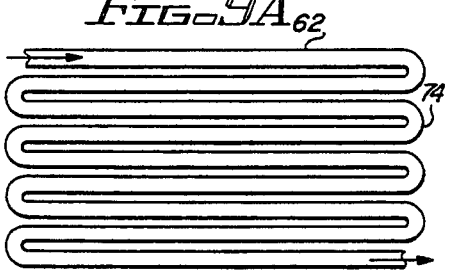
FIG. 9A is a top view illustrating a detail of a bladder used with the air mattress of FIG. 9.

In another embodiment of the invention as shown in FIG. 9, an air floatation system 61 comprises a plurality of bladders 62 within a foam inlay 64 as described in the original embodiment of FIGS 1–7. As further seen in FIG. 9, a foam bottom section 66 and foam top section 68 form an envelope for the bladders 62. A cover 70 encloses the combination. The air floatation system mattress 60 is placed on a bed 72 as illustrated in FIG. 9. As shown in FIG. 9 and further illustrated in FIG. 10, the plurality of bladders 62 are arranged in multiple layers. Three layers are used in the preferred embodiment. The top bladder plane 621 comprises a plurality of bladders 62 each parallel to each other. The middle plane 622 comprises a plurality of bladders arranged parallel to each other and perpendicular to the top layer 621. The bottom plane 623 of bladders 62 are also parallel to each other and perpendicular to the adjacent middle plane 622 such that a criss-crossing of bladders 62 is formed by each plane. In the preferred embodiment, nine bladders 62 are used in each plane and are approximately 26" long. They form a 26" wide section and a mattress comprises three sections. In a given layer and section, the bladders 62 are connected so as to communicate in an alternating end to alternating end fashion 74 as illustrated in FIG. 9A. In this way, the air in the bladder will be forced to flow through any given layer in an series styled pattern. This pattern lends itself to a more stable mattress system 60 especially when the three planes of bladders 621, 622, and 623 are placed in the criss-crossed relationship described. In the preferred embodiment, foam layers 80 are placed between the bladder planes as shown in FIG. 10. Also shown in FIG. 10 is a foam wedge 65 used with a shaped support 63 to snugly engage the bladders 62.

In typical air mattress designs well known in the art, air is pumped into a plurality of bladders and is permitted to leak out of the bladders in a controlled fashion. This controlled leaking creates the need for a large air supply. Large pumps are typically places in proximity to the bed for such a supply. In the embodiment of the invention described, air is not permitted to leak but is controlled by a regulator 76 located between the bladders and the air supply 78. In the preferred embodiment, a manifold and supply lines 82 well known in the art is used to provide air to the plurality of bladders. Because of the low volume of air required to maintain the invention at an established pressure, hospital supply tanks available to patient rooms can be tapped without a noticeable impact on the hospital supply.

In the embodiment of the invention described, internal bladder pressure is regulated by a self relieving regulator 76. As shown in FIG. 10 and further illustrated in FIG. 11, the mattress system 60 comprises an antimicrobial cover 70. The bladders 62 on each plane or layer have a small profile which enhances the stability and gives a more stable mattress feel with minimal resistance to forming to a body lying on the surface of the mattress. The use of smaller tube styled bladders 62 will provide less transfer of vertical deflection to adjacent bladder areas. The criss-crossing described provides further stability and surface contact with the body of a patient or person lying on the mattress. Foam layers 80 are interleaved between adjacent bladders 621, 622 and 622, 623 to provide a familiar mattress feel unlike that of direct contact with the bladders filled with air. The inlay 64, top 68 and bottom 66 foam layers provide the traditional box-like mattress look and integrity expected on such mattress products.

Figure 12A:
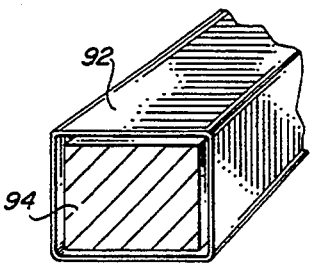
FIG. 12A is a detailed cross-section of the bladder of FIG. 12.
Figure 12B:
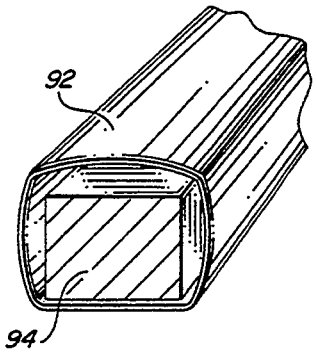
FIG. 12B is a cross-section of the bladder of FIG. 12A expanded under air pressure.
Figure 12C:
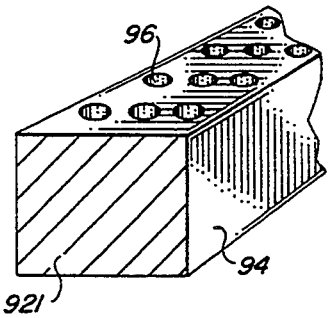
FIG. 12C an alternate form of the foam of FIG. 12A, with lateral borings to aid in reducing compressibility.

Foam mattresses are relatively maintenance free and can provide a certain amount of pressure relief needed for a patient. In another embodiment of the invention as shown in FIG. 12 in a partial cross-sectional view, a specialty mattress 90 comprises bladders 92 having foam elements 94 of varying compression. As illustrated in FIG. 12A, a bladder 92 contains foam 94. In the preferred embodiment, bladders 92 are arranged side by side in a parallel fashion on two planes, a top plane 921 and a middle plane 922 as illustrated in FIG. 12. A third bottom plane comprises a foam section 923. The foam 94 on the top plane 921 is more compressible or softer than the foam 94 on the middle plane 922. The bottom plane 923 comprises the firmest or least compressible foam. The foam 94 contained in the bladders 92 of the top plane 921 comprise borings 96 or pockets of air to improve on reducing the compressibility. As described in an earlier embodiment, the bladders 92 are filled with air under pressure in order to convert from a foam mattress to an air mattress. Under pressure, the bladders 92 expand; and the foam 94 no longer carries a load of a person's body; thus the mattress performs as an air mattress after inflation. The amount of pressure will determine whether or not the foam will have an effect on the support. Based on the needs of the person resting on the mattress, a predetermined pressure is selected and maintained via the regulation method described earlier.

The specialty mattress 90 also comprises a cover 70. In the preferred embodiment as illustrated in FIG. 12, the bottom plane 923 is dimensioned on its ends to wrap around the sides of the middle plane 923 and provide mattress integrity.

The various disclosed embodiments of the invention were tested for pressure on areas of the body typically experiencing pressure ulcers. The following table illustrates the effectiveness of the invention in reducing pressure levels at various contact points to below the capillary closure level of 32 mm HG.

TABLE 1

Pressure Point Testing
(Pressure in millimeters of Hg)

| | Embodiment | | | |
|---|---|---|---|---|
| Body Location | FIG. 1 | FIG. 8 | FIG. 9 | Std |
| Sacral/Coccyx | 15 | 23 | 25 | 38 8 |
| Trochanter | 26 | 21 | 22 | 136 51 |
| Heel/Lower Calf | 13 | 17 | 13 | 141 40 |
| Scapula | 19 | 18 | 17 | N/A |
| Head | 20 | | | |

The tests for the embodiments of the invention were conducted in 1991 and submitted in a report by Twin City Testing Corporation, St. Paul, Minn. on Oct. 8, 1991. The test results and the comparison to the standard hospital mattress (Std) pressure data taken from the Gaymar report are used for relative comparison only and are not intended to predict any specific technological result.

Further evaluations of the mattress design of FIG. 8 were made during the period beginning Dec. 4, 1991 to Feb. 16, 1992. Evaluations were conducted at two Florida nursing homes owned by the same company and using similar protocol including the use of pressure relieving mattresses. The studies comprise the use of forty patients. Prior to commencement, measures were taken to insure that the method and type of services were similar at both facilities. Photos were taken before, during and after evaluation. Patients at one facility were placed on the mattress of FIG. 8 and evaluated on a bi-monthly basis, while patients at the second facility were similarly evaluated.

The study started with twenty patients on the invention and ended with sixteen as a sample for evaluation. Thirteen patients remained for evaluation of the control group not using the invention. Patients at both facilities received the same dietary and treatment care. Staff levels were comparable at both facilities as was quality of care. Likewise modes of treatment for pressure ulcers were the same, even to using the same products.

Of the control group, five patients at risk to skin breakdown but without existing skin destruction remained unchanged even though all were on a pressure relieving mattress. One other patient with two areas of skin breakdown had partial improvement with one area improved but the other area worsened. This patient was also on a pressure relieving mattress. One other patient showed slow improvement. Two others with existing skin breakdown stayed the same even on a pressure relief mattress. Four patients with existing skin breakdown actually got worse without deterioration in their general health status. The last control patient was unavailable for study during the evaluation session.

For the invention test group using the second embodiment of FIG. 8, five patients at high risk for skin breakdown showed no skin breakdown at the end of the evaluation period. Twelve patients with existing skin destruction had complete healing or improvement of their skin condition. One of these patients having multiple skin breakdown had excellent improvement but experienced failing health and skin destruction returned.

In general, these findings indicate that mattresses according to the designs described above provide constant therapeutic pressure relief.

This concludes the description of the preferred embodiments. A reading by those skilled in the art will bring to mind various changes without departing from the spirit and scope of the invention. It is intended, however, that the invention only be limited by the following appended claims.

What is claimed is:

1. A mattress for use in a hospital, nursing home or other healthcare facility to avoid pressure ulcers while providing long-term patient comfort, the mattress comprising:

a resilient support comprising a bottom portion with upwardly extending sides, defining a cavity adapted to accomodate a plurality of bladders;

a plurality of individual bladders positioned adjacent and vertically spaced relative to each other within the cavity of the support, each bladder formed of plural plastic sheets having an edge seam for enclosing the periphery of the bladder and plural, generally parallel seams for forming a plurality of elongated chambers extending in a generally parallel direction across each bladder with the adjacent chambers in fluid communication with each other, the parallel direction of the chambers of one bladder being substantially normal to the parallel direction of the chambers in an adjacent, vertically spaced, bladder;

means for maintaining a fluid pressure within each bladder; and wherein an elongated foam member is disposed in each of the elongated chambers of at least one of the bladders.

2. The mattress recited in claim 1 wherein the fluid comprises water.

3. The mattress recited in claim 1 wherein the means for maintaining a fluid pressure comprises means for supplying air under pressure into each bladder.

4. The mattress recited in claim 3 wherein the means for supplying air under pressure comprises means for coupling each bladder to a facility air supply.

5. The mattress recited in claim 1 wherein the support means comprises a foam bottom support having an upper surface for supporting all of the bladders.

6. The mattress recited in claim 5 wherein the foam bottom support comprises sides extending upwardly about the periphery of the supported bladder.

7. The mattress recited in claim 6 further comprising a wedge fitted between the periphery of the bladders and the side of the foam bottom support.

8. The mattress recited in claim 6 further comprising a foam layer over the bladders.

9. The mattress recited in claim 6 wherein the bladders extend end to end and are filled with water.

10. The mattress recited in claim 1 wherein each seam defines a seam weld plane, and wherein each sheet extends from each seam weld at an angle substantially less than 90° relative to the weld plane.

11. The mattress recited in claim 10 wherein each bladder is formed of opposing first and second outer sheets and an inner sheet alternately welded to the inside of the first and second outer sheets to form the seam welds.

12. The mattress recited in claim 11 wherein each seam weld extends beyond the edge of the inner sheet at the point of the seam weld.

13. The mattress recited in claim 11 wherein the inner sheet defines a gradual opening extending toward a central area of the chamber.

14. The mattress recited in claim 10 wherein each bladder is formed of opposing first and second outer sheets and two inner sheets, each inner sheet alternately welded to the inside of one of the first and second outer sheets and to the other inner sheet.

15. The mattress recited in claim 1 further comprising plural elongated foam members disposed in each of the elongated chambers of at least two of the bladders.

16. The mattress recited in claim 15 wherein the foam members in one bladder have a greater firmness than the foam members in another bladder.

17. A healthcare mattress useful in avoiding pressure ulcers while providing long-term patient comfort, the mattress comprising:

a resilient support comprising a bottom portion with upwardly extending sides, defining a cavity adapted to accomodate a plurality of bladders;

first and second bladders upon the support with the first bladder positioned above the second bladder, each bladder formed of plural, generally parallel plastic sheets forming a plurality of elongated chambers extending in a generally parallel direction across each bladder with adjacent chambers in fluid communication;

an elongated foam member disposed in each of substantially all of the elongated chambers of at least the second bladdler; and means for maintaining a fluid pressure within each of the elongated chambers of the first and second bladders wherein the first and second bladders are disposed with the parallel direction of the elongated chambers of the first bladder substantially normal to the parallel direction of the elongated chambers of the second bladder.

18. The healthcare mattress recited in claim 17 further comprising an elongated foam member disposed in each of substantially all of the elongated chambers of the first bladder.

19. The healthcare mattress recited in claim 18 wherein the elongated foam members in the elongated chambers of the second bladder have a greater firmness than the elongated foam members in the chambers of the first bladder.

* * * * *